United States Patent [19]

Krieger

[11] Patent Number: 4,463,655

[45] Date of Patent: Aug. 7, 1984

[54] LINEAR BEARING INSERT FOR FIREARM SLIDE

[76] Inventor: Robert R. Krieger, 1958 Derby, Birmingham, Mich. 48008

[21] Appl. No.: 446,861

[22] Filed: Dec. 6, 1982

[51] Int. Cl.[3] ..... F41C 5/06; F41D 11/00

[52] U.S. Cl. ..... 89/196

[58] Field of Search ..... 89/196, 163

[56] References Cited

U.S. PATENT DOCUMENTS 3,411,404 11/1968 Pachmayr et al. ..... 89/196

3,411,406 11/1968 Pachmayr et al. ..... 89/196

3,411,407 11/1968 Pachmayr et al. ..... 89/196

*Primary Examiner*—Donald G. Kelly

*Attorney, Agent, or Firm*—Hauke & Patalidis

[57] ABSTRACT

A linear bearing insert for the slide-receiver ways of a firearm wherein the slide is reciprocably attached to the receiver by a groove and tongue structure. The insert is in the form of a rod, preferably cylindrical, which is disposed in a groove, preferably the receiver groove, and which has a portion of its peripheral surface in sliding engagement with a partially cylindrical groove formed in the side of a corresponding tongue, such that the bearing surfaces in engagement are cylindrical rather than planar. After wear has taken place, causing objectionable play, the insert may be replaced by a larger size insert such as to compensate for wear and eliminate the play.

9 Claims, 6 Drawing Figures

FIG. 1
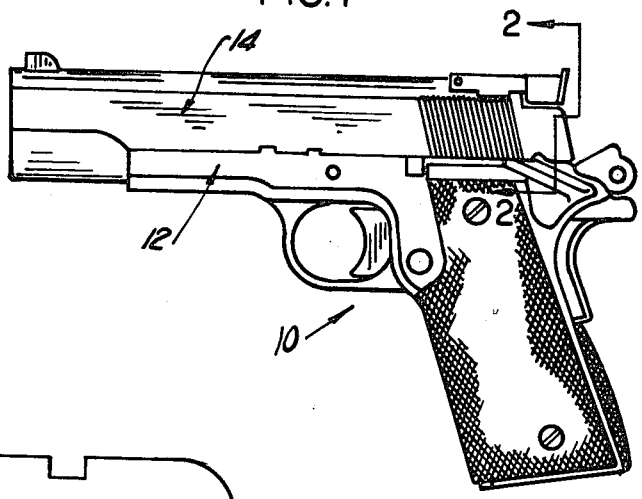
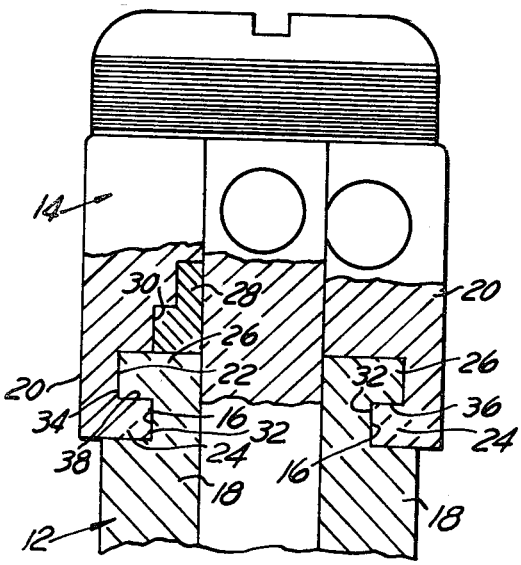
FIG. 2
PRIOR ART
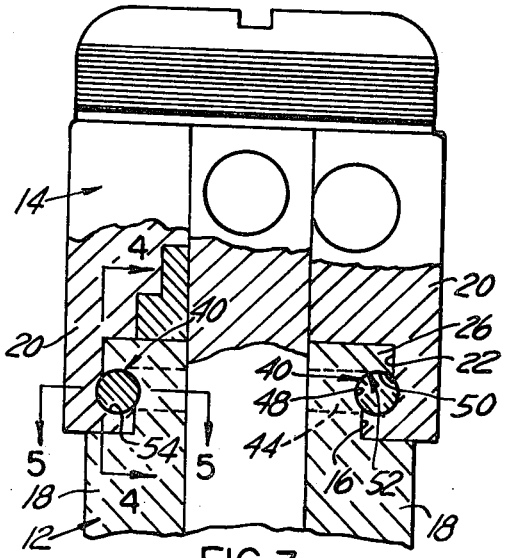
FIG. 3
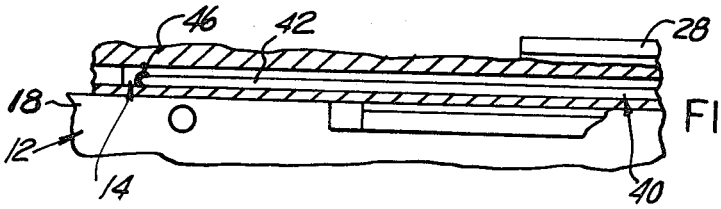
FIG. 4
FIG. 5
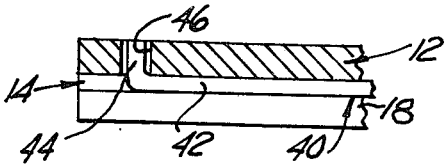
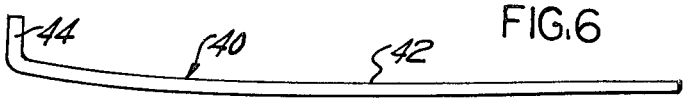
FIG. 6

LINEAR BEARING INSERT FOR FIREARM SLIDE

BACKGROUND OF THE INVENTION

The present invention relates to firearms in general, and more particularly to a removable and replaceable linear bearing insert for the ways between the slide of an automatic firearm, such as a pistol for example and the frame or receiver of the firearm.

In most automatic or semi-automatic firearms, such as automatic pistols for example, the frame or receiver is provided at its top edge with a groove disposed on each side and in which is engaged the inwardly directed tongue or flange of the slide. Reciprocation of the slide, either manually or under the recoil action of a round of ammunition being fired, accomplishes the functions of extracting a spent cartridge through an ejection port, and returning the hammer to the cocked position. The return of the slide under the action of a return spring causes feeding of a fresh cartridge from the magazine or clip into the chamber and causes the bolt to close the chamber, in readiness to fire a subsequent round of ammunition upon depressing the trigger.

The reciprocating motion of the slide relative to the receiver must be smooth, and without binding that may cause jamming. The ways defined between the receiver grooves and the slide tongues or flanges in mutual sliding surface engagement must provide an assembly permitting a smooth reciprocation of the slide, but without undue play that may cause the slide, and consequently the barrel disposed in a longitudinal bore within the slide, to oscillate sideways or in elevation relative to the receiver, in the course of the slide reciprocating motion. Although reciprocation of the slide may be achieved accurately along the longitudinal axis of the receiver ways when the firearm is relatively new, even though manufacturing tolerances and poor match of components may at first result in a slight play within acceptable limits between the slide and the receiver, through wear of the linear bearing surfaces in mutual engagement resulting from repeated firing of the firearm the original tolerances gradually widen, with resulting increased play in the sliding fit between the slide and the receiver. Such increased play is annoying to a sharpshooter, distracting and conducive to reduced accuracy in target practice, more particularly in competition.

In spite of all the loving care given to their favorite firearms by sharpshooters, especially competition marksmen, firearms eventually are entrusted to a skilled gunsmith for modification, for customizing, for repair and for overhaul, including tightening of the slide relative to the receiver. Such tightening of the slide is commonly effected by placing the slide in a vise and slightly bending the slide sidewalls beyond the module of elasticity of the metal such as to narrow the space between the slide tongue inner edges, with the result that the slide tongues engage the receiver grooves with decreased lateral play. If too much pressure is applied by the vise during tightening of the slide, the metal may fracture, thus requiring costly replacement of the slide. Metal may also be welded onto the slide grooves and tongues, and onto the receiver grooves and tongues, and the receiver and the slide are re-grooved with precision such as to provide a more accurate match of the bearing surfaces and a compromise between tight fit and smooth action of the slide.

The present invention provides accurate, smooth and reliable fitting between the slide of a firearm, such as a pistol, and the receiver without causing any mechanical stress to be applied to the slide, without welding, without machining the slide and receiver bearing surfaces, and without modifying the metallurgy or composition of metal and without stressing the metal as results from welding a coating of metal on the bearing surfaces.

SUMMARY OF THE INVENTION

The present invention accomplishes its objects by providing a linear bearing removable insert which, when inserted in place in the ways between the slide and the receiver of a firearm, provides close fit without undue play, without binding, which results in an increase in the surface area of the bearing surfaces in sliding engagement, and which is easily replaceable by a new insert of the same size or of a slightly larger size to take up the play that may result from repeated use of the firearm.

The diverse objects and advantages of the present invention will become apparent to those skilled in the art when the following description of the best mode contemplated for practicing the invention is read in conjunction with the accompanying drawing wherein like reference numerals refer to like or equivalent parts and in which:

BRIEF DESCRIPTION OF THE DRAWING

FIG. 1 is a side elevation view of a firearm such as a conventional .45 caliber automatic pistol;

FIG. 2 is a partial rear elevation and section view along line 2—2 of FIG. 1;

FIG. 3 is a view similar to FIG. 2, but showing the modification of the invention;

FIG. 4 is a partial section from line 4—4 of FIG. 3;

FIG. 5 is a partial section from line 5—5 of FIG. 3; and

FIG. 6 is an elevation view of a slide linear bearing insert according to the present invention.

DETAILED DESCRIPTION OF THE PREFERRED EMBODIMENT

Referring to the drawing, and more particularly to FIGS. 1–2, a conventional automatic pistol 10, the example of which is illustrated being a .45 caliber automatic pistol, has a frame or receiver 12 on the top of which is slidably disposed a slide 14. The structure of the pistol 10 is well known in the art, and further description thereof is omitted herein, except for the portions having relevance to the present invention.

The receiver 12, as best shown at FIG. 2, is provided on each side, proximate its top edge, with a lateral outer rectilinear groove 16 in each of its sidewalls 18. The slide 14 has a pair of parallel sidewalls 20 each provided with an inner rectilinear groove 22 proximate its bottom edge. The bottom edge of the slide 14 forms an inward projecting flange or tongue 24, which fits in the receiver groove 16. In a similar manner, the top edge of the receiver 12 forms a flange or tongue 26, on each side, that fits in one of the corresponding grooves 22 of the slide 14. An extractor lug 28 is affixed on the top of one of the receiver flanges or tongues 26, and the corresponding sidewall 20 of the slide 14 is cut out such as to clear the extractor lug, as shown at 30.

The longitudinal bearing surfaces between each groove 16 in the wall of the receiver 12 and the corresponding flange or tongue 24 of the slide 14, and between each groove 22 of the slide 14 and the corresponding flange or tongue 26 of the receiver 12, define linear ways allowing the slide 14 to freely reciprocate relative to the receiver 12 along a longitudinal axis. The ways bearing surfaces, such as the bottom surface of each groove 16 in the receiver 12 and the corresponding top surface 32 of each slide flange or tongue 24, together with the bottom surface of each slide groove 22 and the corresponding top surfaces 34 of the receiver flange or tongue 26 are subjected to lateral loads during reciprocation of the slide 14 and, when worn, sideways play motion takes place between the slide 14 and the receiver 12. The lateral lower face 36 of each receiver flange or tongue 26, forming one lateral surface of the receiver groove 16 in sliding engagement with the upper lateral surface 38 of the slide flange or tongue 24, is particularly subjected to wear imposed by upwardly directed load upon the slide 14 during operation of the slide. Through wear, the grooves 16 in the receiver 12 and the grooves 22 in the slide 14 tend to become wider, while the flanges or tongues 24 and 26 tend to become narrower.

The invention, as illustrated at FIGS. 3–5, provides a replaceable linear bearing insert 40, preferably circularly cylindrical, and made of steel rod material or any other material such as stainless steel, copper, bronze, or even made of plastic. The linear bearing insert 40 is inserted in the ways between the slide 14 and the receiver 12 such as to define cylindrical bearing surfaces rather than the original conventional flat bearing surfaces. The linear bearing insert 40 is in the form of a rod 42 which is held stationary relative to the receiver 12 by means of its forward end being bent over substantially at right angle, FIGS. 5 and 6, such as to form a hook 44 inserted in a transverse bore 46 drilled through the sidewall 18 of the receiver 12 at the forward end of the receiver groove 16. The bottom surface of the receiver groove 16 is grounded such as to form a shallow partially cylindrical groove 48, FIG. 3, and the lower face 36 of the receiver flange or tongue 26 is ground such as to form a relatively deep partially cylindrical groove 50, such that the insert 40 nests in a partially cylindrical groove 52 at the upper inner corner of the former planar receiver groove 16. The former planar upper surface 38, FIG. 2, of the slide retaining flange or tongue 24 is ground such as to form a shallow cylindrical groove 54 in sliding engagement with a portion of the peripheral surface of the linear bearing insert rod 42. The bearing surfaces in engagement being cylindrical rather than planar have a larger area in engagement as compared to planar surfaces and, if so desired when using a metallic rod 42 for the linear bearing insert 40, a thin coating of an appropriate fluorocarbon resin, such as polytetrafluoroethylene or the like, may be deposited on the surface of the rod 42 for providing a dry lubricant-like quality to the rod bearing surface.

The rod 42 may be provided with a slight outward bow, as shown at FIG. 6 in an exaggerated manner, if so desired, such as to accommodate in a spring-like manner a certain amount of side play resulting from repeated reciprocating actions of the slide 14 relative to the receiver 12.

Through usage and after an objectionable amount of play has been created as a result of wear of the peripheral portion surface of the rod 42, and wear of the partially cylindrical groove 54 in the slide 12, that play can be taken up by removing the pair of linear bearing inserts 40 and replacing them by a pair of linear bearing inserts of a slightly larger diameter, for example 0.001 to 0.002 in. (0.025–0.05 mm) oversize.

The linear bearing insert 40 of the invention is dimensioned in size such as to be preferably slightly more in diameter than the depth of the linear planar groove 16 in the receiver 12. For example, typically for a .45 caliber pistol such as the Colt's MK IV, the preferred diameter of the rod 40 is approximately in the range of 0.075 to 0.085 in. (1.9–2.16 mm).

Having thus described the present invention by way of a typical embodiment thereof, having been shown and described for illustrative purpose only, what is claimed as new is as follows:

1. In a firearm having a slide member reciprocable relative to a receiver member, wherein one of said members has a linear planar groove in which is slidably engaged a corresponding linear tongue formed in the other of said members, the improvement consisting of a linear bearing insert fixedly disposed in said groove and having a portion of its peripheral surface slidably engaged in a corresponding groove formed on a side surface of said tongue.

2. The improvement of claim 1 wherein said insert is in the form of a rod.

3. The improvement of claim 2 wherein said rod has an end bent over substantially at right angle, and said rod is fixedly attached in said groove by said bent over end portion inserted in a corresponding bore disposed at the bottom of said groove.

4. The improvement of claim 2 wherein said rod is circularly cylindrical.

5. The improvement of claim 2 wherein said rod is metallic.

6. The improvement of claim 5 wherein said rod has a thin coating of polytetrafluoroethylene.

7. The improvement of claim 1 wherein said linear bearing insert is fixedly disposed in said groove in the receiver member.

8. The improvement of claim 2 wherein said linear bearing insert is fixedly disposed in said groove in the receiver member.

9. The improvement of claim 3 wherein said linear bearing insert is fixedly disposed in said groove in the receiver member.

* * * * *